US007044093B2

(12) United States Patent
Petrie

(10) Patent No.: US 7,044,093 B2
(45) Date of Patent: May 16, 2006

(54) VARIABLE VALVE TIMING SYSTEM FOR AN INTERNAL COMBUSTION ENGINE

(75) Inventor: Tad L. Petrie, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/021,074

(22) Filed: Dec. 22, 2004

(65) Prior Publication Data

US 2005/0103289 A1 May 19, 2005

Related U.S. Application Data

(63) Continuation of application No. 10/409,997, filed on Apr. 9, 2003, now abandoned.

(60) Provisional application No. 60/413,422, filed on Sep. 25, 2002.

(51) Int. Cl.
*F01L 1/18* (2006.01)

(52) U.S. Cl. ..... 123/90.44; 123/90.12; 123/90.11

(58) Field of Classification Search ..... 123/90.11, 123/90.12, 90.13, 90.39, 90.44, 90.16
See application file for complete search history.

(56) References Cited

U.S. PATENT DOCUMENTS 4,794,890 A 1/1989 Richeson, Jr.
4,930,463 A 6/1990 Hare, Sr.
5,099,884 A 3/1992 Monahan
5,103,779 A 4/1992 Hare, Sr.
5,537,976 A * 7/1996 Hu ..... 123/322
5,937,806 A 8/1999 Lyko et al.
6,095,486 A 8/2000 Ivers et al.
6,237,551 B1 5/2001 Macor et al.
6,321,706 B1 11/2001 Wing
6,347,619 B1 * 2/2002 Whiting et al. ..... 123/568.12
6,688,280 B1 * 2/2004 Weber et al. ..... 123/305
6,691,652 B1 2/2004 Kammerdiener et al.
6,701,879 B1 3/2004 Diehl et al.

* cited by examiner

*Primary Examiner*—Thomas Denion
*Assistant Examiner*—Ching Chang

(57) ABSTRACT

An internal combustion engine and method of operating the engine is provided. The engine comprises an engine block defining an engine cylinder, a piston reciprocatingly positioned in the engine cylinder, a head connected with the engine block, the head defining an inlet port and an exhaust port, an intake valve positioned in the inlet port, the intake valve configured to restrict flow through the intake port to the cylinder, an exhaust valve positioned in the exhaust port, the exhaust valve configured to restrict flow through the exhaust port to the cylinder, a cam connected with the intake valve to open the intake valve, and an engine valve actuator connected with the intake valve. The engine valve actuator is configured to hold either or both the intake valve and or exhaust valve open after the cam opens one or both of the valves.

13 Claims, 4 Drawing Sheets

VARIABLE VALVE TIMING SYSTEM FOR AN INTERNAL COMBUSTION ENGINE

This application is a continuation of application Ser. No. 10/409,997, filed Apr. 9, 2003, abandoned, which claims priority to Provisional Application No. 60/413,422, filed Sep. 25, 2002; the content of all of the above are hereby incorporated by reference.

TECHNICAL FIELD

This disclosure relates generally to internal combustion engines and, more particularly, to an apparatus for varying valve timing.

BACKGROUND

The operation of an internal combustion engine requires, among other things, the timed opening and closing of a plurality of valves. For example, with a typical four-stroke engine, one of ordinary skill in the art will readily recognize such an engine operates through four distinct strokes of a piston reciprocating through a cylinder, with intake and exhaust valves operating in conjunction with the piston. In an intake stroke, the piston moves from top dead center (TDC) where the piston is near a head portion to bottom dead center (BDC) where the piston is at a predetermined distance from the head. An intake valve is opened allowing air or a fuel and air mixture into the cylinder as the piston travels from TDC to BDC. In a subsequent compression stroke, the piston moves from BDC to TDC while both an exhaust valve and intake valve inhibit gas flow from the cylinder, thereby compressing the air and any residual gasses within the cylinder. A combustion or power stroke follows the compression stroke wherein fuel is injected into the compressed air and thereby ignited. Alternatively, an ignition device such as a spark plug may ignite the mixture of fuel and air. The force resulting from the combustion pushes the piston toward BDC while both the intake and exhaust valves are closed. Finally, the piston reverses direction and moves back toward TDC with the exhaust valve open, thereby pushing the combustion gases out of the cylinder.

Historically, valves on internal combustion engines have been operated in a regular cyclical fashion through the operation of a cam mechanically connected to the valves. Mechanical operation provides an efficient transfer of energy. However, advanced engine cycles may require at least temporary changes in the regular cyclical operation.

As an example, a Miller cycle in an internal combustion engine may be desired to reduce the compression work while maintaining a desired expansion ratio. One method of operating an engine in a Miller cycle closes an intake valve later than provided for by regular cyclical operation of a cam. The exhaust valve may also close later than provided for by the cam to provide internal exhaust gas recirculation (EGR). As known by those skilled in the art, EGR reduces the oxygen available for combustion and reduces formation of an uncertain form of oxides of nitrogen (NOx).

In U.S. Pat. No. 6,237,551 issued to Macor et al. on 29 May 2001, a system is described to vary a duration the valve is in an open position. The cam is connected to a rocker arm to cyclically operate a valve. A hydraulic linkage is placed between the rocker arm and the valves. When activated, the hydraulic linkage allows the rocker arm to move the valve according to a profile of the cam. This system, may also be called a "lost motion" system, allows the valve duration to be shortened by decoupling the cam movement from the valve actuation. The decoupling of the valve from cam allows the valve to return to a valve seat or closed position earlier than produce by the cam movement. However, accidental decoupling or loss of hydraulic pressure will let all valves return to their closed position. The engine in turn will not be able to operate.

As an alternative an actuating mechanism may instead alter the valve movement by acting against the valve to hold the valve as shown in U.S. Pat. No. 6,321,706 issued to Wing on 27 Nov. 2001. In normal operation, the cam cyclically operates on the valve. However, the regular cyclical operation may be altered to extend duration of valve in its open position through the use of various valve holding devices. In one embodiment, a valve member has a shaft extending through a magneto-rheological fluid placed in a sealed chamber. The shaft includes an enlarged portion positioned within the sealed chamber. The valve closing may be delayed by energizing a magnetic field near the chamber to increase the resistance against the enlarged portion moving through the magneto-rheological fluid and delaying closing of the valve. The valve holding device of Wing requires a specifically designed valve shaft and spring arrangement.

The present disclosure is directed to overcoming one or more of the problems or disadvantages associated with the prior art.

SUMMARY OF THE INVENTION

In one aspect of the present invention an engine valve actuator for varying valve timing includes an actuator cylinder. An electromagnetic coil connects with the actuator cylinder. An actuator piston is reciprocatingly disposed in the actuator cylinder. A biasing means is connected with the actuator piston. An electrorheological fluid is disposed in at least a portion of the actuator cylinder.

In another aspect of the present invention an internal combustion engine includes a cam connecting with an intake valve and exhaust valve to cyclically move the valves. An engine valve actuator connects with intake valve. The engine valve actuator includes an actuator cylinder. An actuator piston is reciprocatingly positioned in the actuator cylinder along with an elecrtorheological fluid. An electromagnetic coil is positioned in close proximity with the electrorheological fluid. A biasing means is connected with the actuator piston.

DETAILED DESCRIPTION

Figure 1:
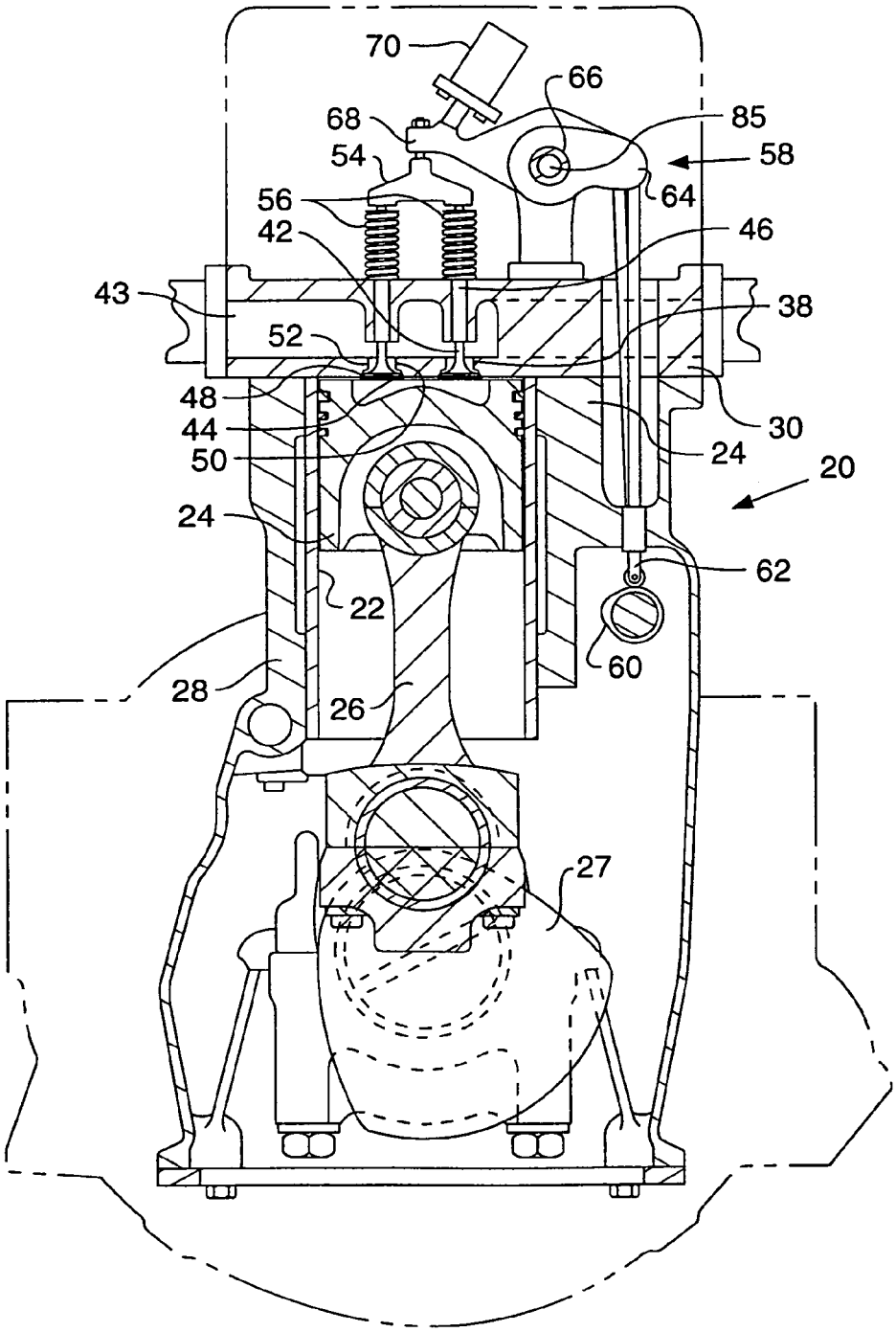
FIG. 1 is cross-sectional view of an engine having an engine valve actuator with an embodiment of the present invention.

Referring now to the drawings, and with specific reference to FIG. 1, an embodiment of an internal combustion engine is generally referred to by reference numeral 20. While the engine 20 is depicted and will be described in further detail herein with reference to a four stroke, internal combustion diesel engine, it is to be understood that the teachings of the disclosure can be employed in conjunction with any other type of reciprocating engine such as spark ignited engines, two-stroke engines, or rotary engines.

The engine 20 may include a plurality of engine cylinders 22 in each of which is reciprocatingly mounted an engine piston 24. As known in the art, the engine 20 may include any number of cylinders and may be arranged in various manners such as, for example, in-line or "V". A connecting rod 26 connects with each engine piston 24, and in turn connects to a crank shaft 27 so as to capitalize on the motion of the engine piston 24 to produce useful work in a machine (not shown) with which the engine 20 is associated. Each engine has an engine block 28 defining the cylinder 24 and a cylinder head 30.

A pair of exhaust ports 38 and intake ports (not shown) may be provided in the cylinder head 30 to allow for fluid communication into and out of the engine cylinder 22. In normal engine operation, air may be allowed to enter the engine cylinder 22 through the intake ports, while combustion or exhaust gases may be allowed to exit the engine cylinder 22 through the exhaust ports 38. An exhaust valve 42 may be provided within each gas port. As shown the exhaust ports 38 and exhaust valves 42 will be described in relation to an exhaust system. However, it should be understood that the intake ports and intake valve element act in similar manner as known in the art.

Each of the exhaust valves 42 may include a valve head 44 from which a valve stem 46 extends. The valve head 44 includes a sealing surface 48 adapted to seal against a valve seat 50 about a perimeter 52 of the valve ports 38. A bridge 54 is adapted to contact the valve stems 46 of the valve 42. A valve spring 56 imparts force between the top of each valve stem 46 and the cylinder head 30, thereby biasing the stem 46 away from the cylinder head 30 and thus biasing the valve head 44 into seating engagement with the corresponding valve seats 50 or move the exhaust valve 42 into a closed position blocking the exhaust port 38.

Movement of the exhaust valve 42 is controlled not only by the springs 56, but by a cam assembly 58 as well. As one of ordinary skill in the art will readily recognize, rotation of the cam 60 cyclically causes a push rod 62 to rise, thereby causing a rocker arm 64, connected thereto, to pivot about a pivot 66. In so doing, an end 68 of the rocker arm 64 is caused to move downwardly and thereby move the exhaust valve element 42 to an open position unblocking the exhaust port 38. Under normal engine operation, the cam 60 imparts sufficient force to the valve stem 46 to overcome the biasing force of the spring 56 and thereby push the valve head 44 away from the valve seat 50, to move the exhaust valve 42 to an open position. Further rotation of the cam 60 allows the spring 56 to push the end 68 of the rocker arm 64 upward and the push rod 62 downward until the cam 60 completes another revolution. Alternatively, the cam 60 may act directly on either the rocker arm 64 or valve element 42 in a conventional manner.

In certain modes of engine operation, such as with the compression release braking, Miller cycle operation, and EGR referenced above, it is desirable for the exhaust valves 42 to be held in the open position for longer periods, or at a timing sequence other than that dictated by the cam 60. In such situations, an engine valve actuator 70 may be used to so hold the exhaust valve 34 in the open position.

Figure 2:
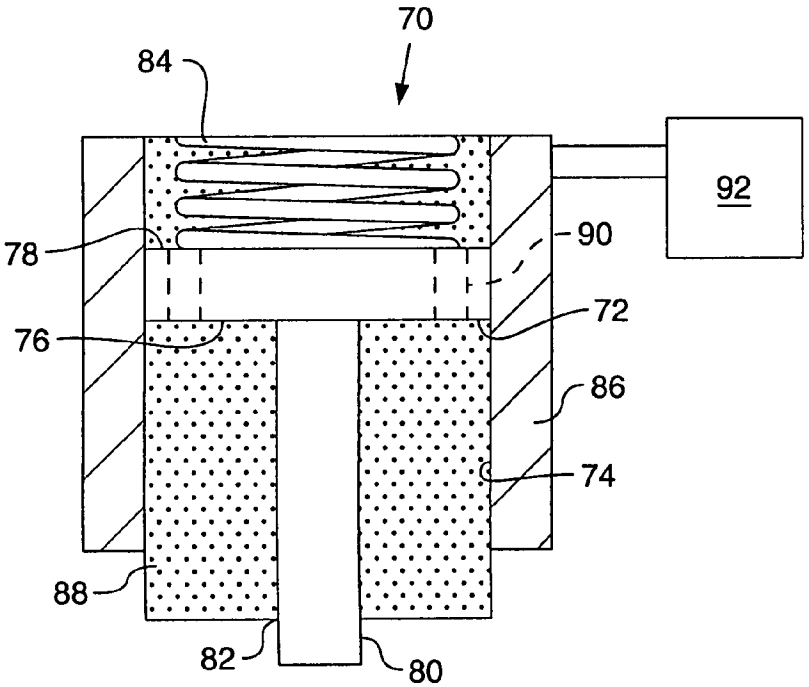
FIG. 2 is a schematic representation an engine valve actuator having an embodiment of the present invention.

As shown in FIG. 2, the engine valve actuator 70 includes an actuator piston 72 reciprocatingly positioned in an actuator cylinder 74. The actuator piston has an actuating surface 76 opposite a control surface 78. An actuating rod 80 may extend from the actuating surface 76 through an opening 82 in the actuating cylinder 74 to engage the actuator arm 68. In this embodiment, a spring 84 attaches to the control surface 78 as a biasing means to urge the actuating piston to engage with the exhaust valves 42. Any conventional biasing means may be used such as a pressurized hydraulic or pneumatic cylinder that may be passively or actively controlled. An electromagnetic coil 86 is connected with the actuator cylinder 74. The electromagnetic coil 86 may be any conventional device capable of generating a magnetic flux or electric current operatively associated with an electrorhelological fluid 88. As shown, the electromagnetic coil 86 may be integral with actuator cylinder 74. The electrorehological fluid 88 is contained within the actuator cylinder 74. The electrorheological fluid 88 includes magnetorheological fluids and other any fluid where viscosity may be controllable in response to controlling an applied magnetic flux or electrical current. The electrorheological fluid 88 may pass from the actuating surface 76 to the control surface 78 via flow control device 90 represented by a plurality of orifices in the present embodiment. An electronic controller 92 is connected with the electromagnetic coils 86.

Figure 3:
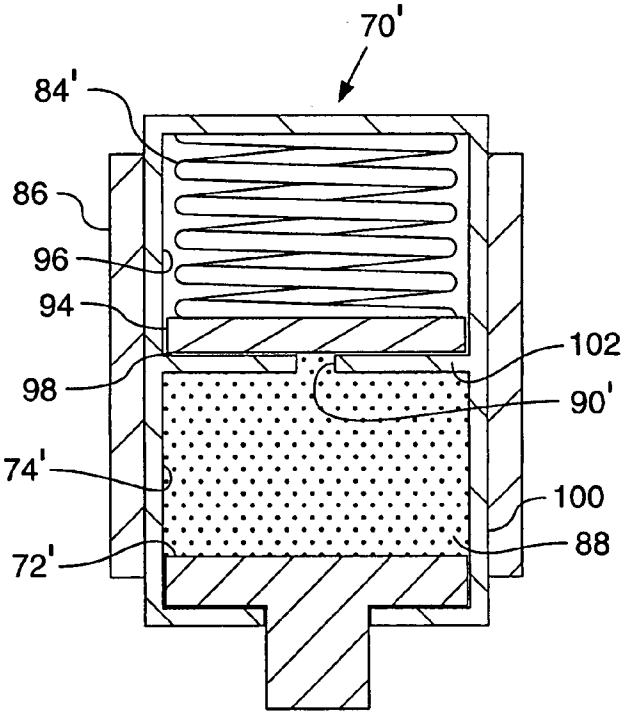
FIG. 3 is a schematic representation of an engine valve actuator having another embodiment of the present invention.

An alternative engine valve actuator 70' shown in FIG. 3 includes the actuator piston 72', a control piston 94, the actuator cylinder 74', and a control cylinder 96 (where the "'" represents a component corresponding to an element of the embodiment shown in FIG. 2). The control piston 94 is reciprocatingly positioned in the control cylinder 96. The spring 84' or similar biasing means positions the control piston 94 so as to reduce a control volume 98 in the control cylinder 96 for the electrorheological fluid 88. In this embodiment, the electrorheological fluid 88 is in fluid contact with the control surface 78 of the actuator piston 72'. The actuator cylinder 74' and control cylinder 96 may be formed from a single cylinder 100 separated by a partition 102. The flow control device 90', represented by an orifice in this embodiment, is positioned in the partition 102. The flow control device 90' allows the electrorhelogoical fluid 88 to fluidly communicate between the control cylinder 96 and the actuator cylinder 74'. While this embodiment shows an orifice, any conventional flow control device 90' may be used. The electromagnetic coils 86' in this embodiment are shown as being attached to the single cylinder 100.

INDUSTRIAL APPLICABILITY

Figure 4:
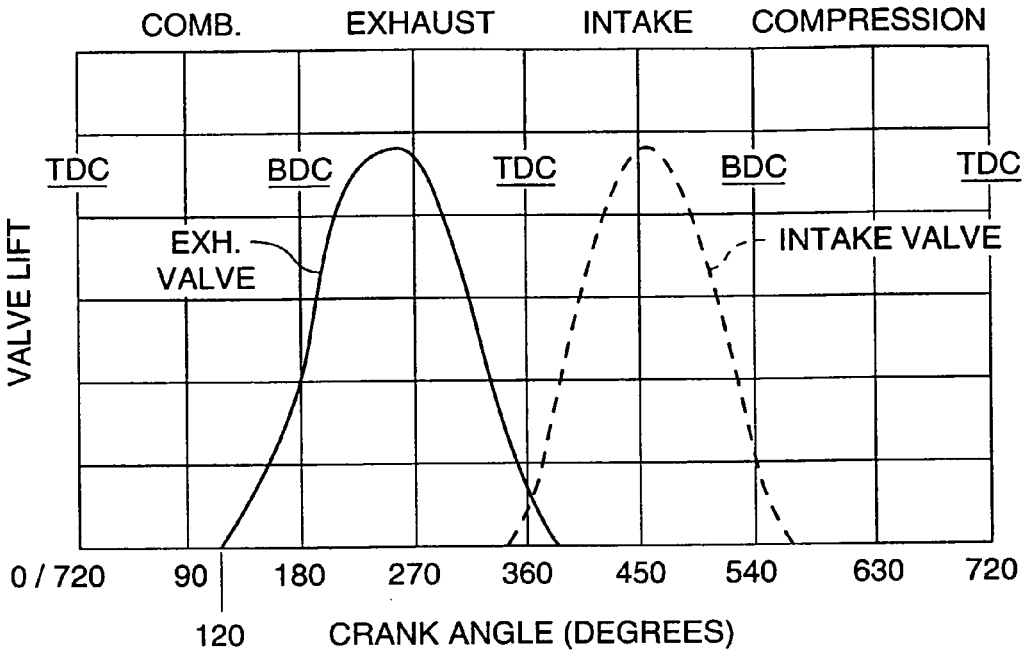
FIG. 4 is a graph plotting valve lift vs. engine crank angle during normal operation.

FIG. 4 shows a typical trace of an exhaust valve 42 when operated using the cam assembly 58. Each valve opens and closes in a regular, cyclical fashion (i.e. at a predetermined crank angle for each engine cycle.) Alternative engine cycles such as internal EGR and Miller cycle operation require alteration of the regular, cyclical cam operation. In the present invention, the engine valve actuator 70 may be used with existing engine designs without modifying existing components.

Figure 5:
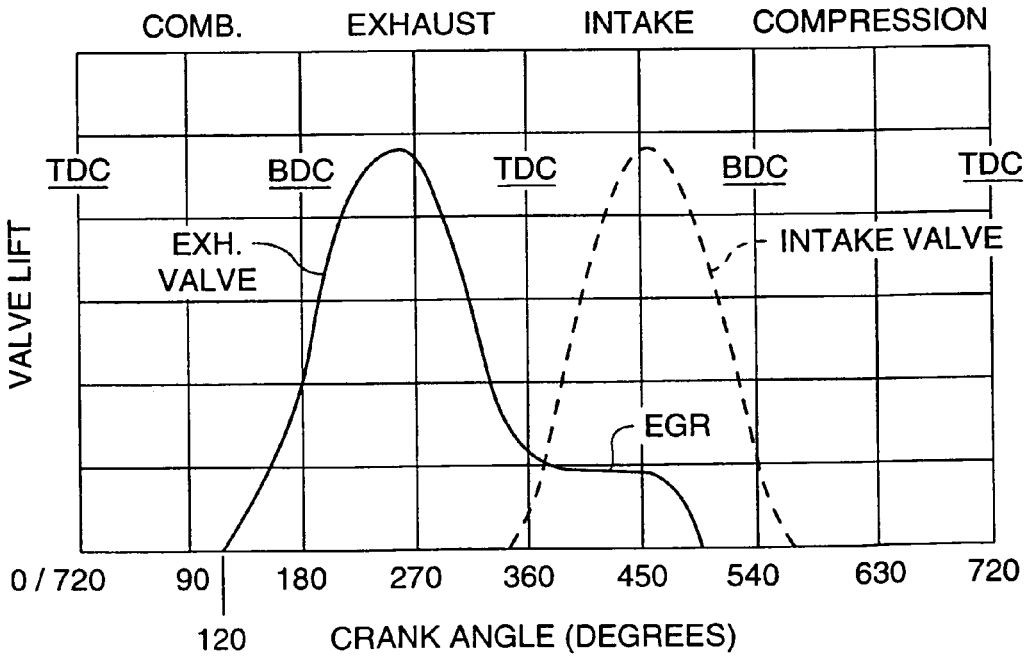
FIG. 5 is a graph plotting valve lift vs. engine crank angle during internal exhaust gas recirculation operation.

Taking internal EGR shown in FIG. 5, moving the exhaust valve 42 to the closed position may be delayed by sending a signal to the electromagnetic coil 86. During an exhaust stroke, as the piston 24 moves toward TDC, the cam will cause the exhaust valve 34 to move away from the seat 50.

To prevent the exhaust valve from following the cam motion, a signal is sent by the controller 92 to establish a magnetic flux (not shown) in the electrorhelogical fluid 88 causing the viscosity to increase. Motion of the actuator piston 72 is slowed or stopped by the increased resistance due to the change in viscosity. At such time the exhaust valve 34 is desired to return to its seat 50, the controller 92 terminates the signal to reduce or eliminate the magnetic flux. The exhaust valve 42 returns to its seat 50. The flow control device 90 provides dampening to the actuator piston 72.

Continuing with the example of EGR, when the exhaust valve 34 is held in the open position as the engine piston 24 ascends to a TDC position, and remains in the open position after the engine piston 24 reverses and descends. A portion of the exhaust gases vented from neighboring engine cylinders 22 through the exhaust ports 36 are thereby reintroduced to the engine cylinder 22 by the resulting pressure differential. After a predetermined stroke length (e.g., ninety degrees of a seven hundred and twenty degree four stroke cycle), the exhaust valve 42 is in the closed position, while the intake valve remains in the open position to complete the intake stroke as explained above.

Figure 6:
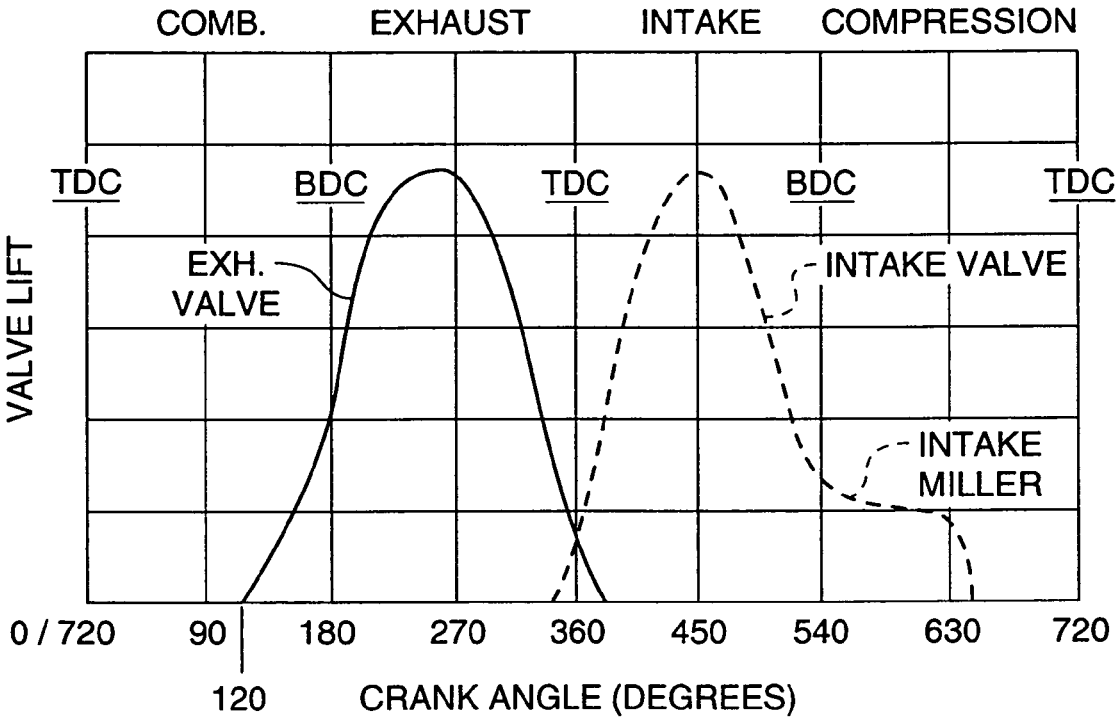
FIG. 6 is a graph plotting valve lift vs. engine crank angle during Miller cycle operation.

The teachings of the present disclosure can also be used to provide Miller cycle benefits. As illustrated in FIG. 6, the intake valves may be held open during the initial stages of the compression stroke to thereby reduce the compression work of the engine 20 and provide the engine efficiencies of the Miller cycle as well known by those of ordinary skill in the art. The intake valve could be so held by employing the engine actuator 70 after the cam assembly 58 moves the intake valve to the open position during the intake stroke. More specifically, as the intake valve is about to be moved to the closed position by the spring 56 at the conclusion of a normal intake stroke, the electromagnetic coil 86 could be actuated so as to slow movement of the actuator piston and thereby the intake valve toward the seat 50.

Other aspects and features of the present disclosure can be obtained from a study of the drawings, the disclosure, and the appended claims.

The invention claimed is:

1. A method of operating a four-stroke internal combustion engine, said engine comprising a cam and an engine valve actuator, both of which are operably connected to an intake valve, said valve actuator comprising an actuator cylinder having an actuator piston reciprocatingly positioned in the actuator cylinder, an electrorheological fluid contained in the actuator cylinder, an electromagnetic coil proximate to the electrorheological fluid, and a biasing mechanism connected with a control surface of the actuator piston, the method comprising the steps of:

opening the intake valve with the cam to let air flow into an engine cylinder during an intake stroke;

energizing the electromagnetic coil to hold open the intake valve during a portion of a compression stroke;

de-energizing the electromagnetic coil to close the intake valve during the compression stroke;

injecting fuel into the engine cylinder during the compression stroke and after the intake valve is closed; and combusting the fuel during the compression stroke and an expansion stroke.

2. The method of claim 1, further comprising the step of opening an exhaust valve during an exhaust stroke and holding open the exhaust valve during a portion of the intake stroke to let at least some exhaust gas enter an engine cylinder from an exhaust manifold.

3. The method of claim 2, in which the step of holding open the exhaust valve during a portion of the intake stroke results in the exhaust valve being held open less than one half of the exhaust valve's full-open position.

4. The method of claim 3, in which the step of holding open the exhaust valve during a portion of the intake stroke results in the exhaust valve being held open less than one third of the exhaust valve's full-open position.

5. The method of claim 1, in which the step of energizing the electromagnetic coil to hold open the intake valve during a portion of a compression stroke results in the intake valve being held open less than one half of the intake valve's full-open position.

6. The method of claim 5, in which the step of energizing the electromagnetic coil to hold open the intake valve during a portion of a compression stroke results in the intake valve being held open less than one third of the intake valve's full-open position.

7. The method of claim 1, in which the step of energizing the electromagnetic coil to hold open the intake valve during a portion of a compression stroke results in the intake valve being held open during a majority portion of the compression stroke.

8. A method of operating a four-stroke internal combustion engine, said engine comprising a cam and an engine valve actuator, both of which are operably connected to an exhaust valve, said valve actuator comprising an actuator cylinder having an actuator piston reciprocatingly positioned in the actuator cylinder, an electrorheological fluid contained in the actuator cylinder, an electromagnetic coil proximate to the electrorheological fluid, and a biasing mechanism connected with a control surface of the actuator piston, the method comprising the steps of:

opening the exhaust valve with the cam to let exhaust gas exit an engine cylinder during an exhaust stroke;

energizing the electromagnetic coil to hold open the exhaust valve during a portion of in intake stroke to permit some recirculated exhaust gas to enter the engine cylinder from an exhaust manifold;

opening the intake valve with the second cam to let air flow into the engine cylinder during the intake stroke;

energizing the second electromagnetic coil to hold open the intake valve during a portion of a compression stroke;

de-energizing the second electromagnetic coil to close the intake valve during the compression stroke; and combusting the fuel during the compression stroke and an expansion stroke.

9. The method of claim 8, in which the step of energizing the second electromagnetic coil to hold open the intake valve during a portion of a compression stroke results in the intake valve being held open less than one half of the intake valve's full-open position.

10. The method of claim 9, in which the step of energizing the second electromagnetic coil to hold open the intake valve during a portion of a compression stroke results in the intake valve being held open less than one third of the intake valve's full-open position.

11. The method of claim 8, in which the step of energizing the electromagnetic coil to hold open the exhaust valve during a portion of an intake stroke results in the exhaust valve being held open less than one half of the exhaust valve's full-open position.

12. The method of claim 11, in which the step of energizing the electromagnetic coil to hold open the exhaust valve during a portion of an intake stroke results in the exhaust valve being held open less than one third of the exhaust valve's full-open position.

13. The method of claim 8, in which the step of energizing the second electromagnetic coil to hold open the intake valve during a portion of a compression stroke results in the intake valve being held open during a majority portion of the compression stroke.

* * * * *